United States Patent [19]

Wilmes

[11] Patent Number: 4,582,377

[45] Date of Patent: Apr. 15, 1986

[54] CROSS CONNECTION LINK FOR MODULAR TERMINAL BLOCKS

[75] Inventor: Manfred Wilmes, Detmold, Fed. Rep. of Germany

[73] Assignee: C. A. Weidmuller GmbH & Co, Detmold, Fed. Rep. of Germany

[21] Appl. No.: 595,089

[22] Filed: Mar. 30, 1984

[30] Foreign Application Priority Data

Apr. 2, 1983 [DE] Fed. Rep. of Germany ..... 3312002

[51] Int. Cl.[4] ..... H01R 31/08

[52] U.S. Cl. ..... 339/19

[58] Field of Search ..... 339/18 R, 18 B, 18 C, 339/18 P, 19, 222, 198 N; 174/72 B; 361/407

[56] References Cited

U.S. PATENT DOCUMENTS

| | | | |
|---|---|---|---|
| 2,349,629 | 5/1944 | Lazich et al. | 339/19 |
| 3,054,025 | 9/1962 | Edmunds | 339/198 N |
| 3,128,142 | 4/1964 | Jacobs et al. | 339/198 N |
| 3,249,905 | 5/1966 | Ruehlemann | 339/18 C |
| 3,601,754 | 8/1971 | Filson | 339/19 |
| 3,708,609 | 1/1973 | Iosue et al. | 174/72 B |
| 3,951,496 | 4/1976 | LeRouzic | 339/222 |
| 4,194,801 | 3/1980 | Fitzler et al. | 339/19 |

FOREIGN PATENT DOCUMENTS

| | | | |
|---|---|---|---|
| 2736664 | 2/1978 | Fed. Rep. of Germany . | |
| 557332 | 11/1943 | United Kingdom | 174/72 B |

OTHER PUBLICATIONS

IBM Bulletin, Arnold et al., vol. 13, No. 6, p. 1628, 11-1970.

IBM Bulletin, Steenburgh, vol. 18, No. 12, p. 3912, 5-1976.

Klippon Catalog, Klippon Electronics Ltd.; Sheerness, Kent, England; pp. 12, 14, 175, 3-1984.

*Primary Examiner*—Neil Abrams

*Attorney, Agent, or Firm*—Sprung Horn Kramer & Woods

[57] ABSTRACT

A cross connection link with a cross strip and downward projecting push on blades below it for modular terminal blocks with perforated current bars that accept the push on blades. A number of push on blades arrayed in a comb mortise along the cross strip are twisted with their flat planes extending transversely with respect to the row along which they are arrayed.

8 Claims, 1 Drawing Figure

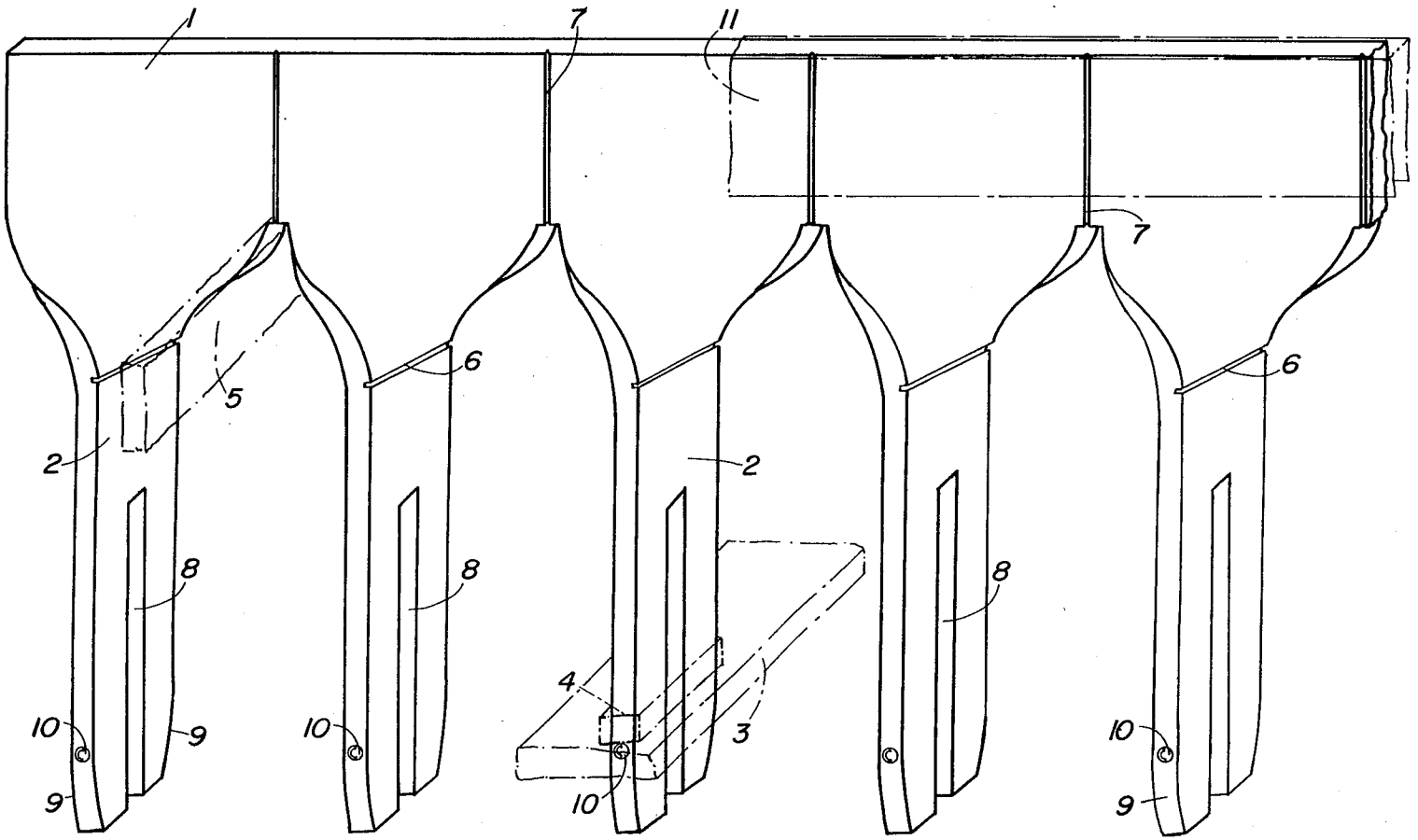
1
2
3
4
5
6
7
8
9
10
11

CROSS CONNECTION LINK FOR MODULAR TERMINAL BLOCKS

BACKGROUND OF THE INVENTION

The present invention relates to a cross connection link with a cross strip and downward projecting push on blades below it for modular terminal blocks with perforated current bars that accept the push on blades.

In a known design of the same generic type, as disclosed in German OS No. 2 736 664 each of the current bars positioned along the cross connection link has two tab holes positioned transversely with respect to it and the cross connection link always consists of a number of U-shaped blade elements that must be inserted in an uninterrupted sequence from one modular terminal block to another in order to produce the desired cross connections. Thus, a large number of separate cross connection link insertion elements must always be kept on hand and a large number must normally also be employed by inserting them in a series of modular terminal blocks. This basically cancels out the theoretical advantage in installing this type of cross connection link in comparison to connectors with threaded terminals. Furthermore, the potential for establishing cross connections is very restricted because it is not possible to eliminate one blade from the series in this type of embodiment.

Various cross connection links are also known from German OS No. 2 357 052 and OS No. 2 914 192 in which a number of spacing or connecting elements that extend to the modular terminal block current bars and to some extent over predetermined break lines are positioned on a cross connection link. The elements that extend to the current bars have a connecting screw that is screwed into a threaded bore in the current bar to connect the particular modular terminal blocks in a cross connection. Cross connection links of this type, with screw terminals, are relatively expensive to manufacture and the necessity of a threaded hole also makes the current bars more expensive. Furthermore, the terminals take relatively long to screw in and this is especially troublesome in relation to spring-pressure or other screwless modular terminal blocks when screwing is not to be carried out to connect the incoming and outgoing electric conductors.

SUMMARY OF THE INVENTION

The object of the present invention is to provide a cross connection link of the aforesaid generic type and of simple design that allows cross connections to be simply and rapidly established completely as desired in a series of modular terminal blocks.

This object is attained in accordance with the invention in a cross connection link of the aforesaid type wherein a number of push on blades arrayed in a comb mortise along the cross strip are twisted with their flat planes extending transversely with respect to the row along which they are arrayed.

A cross connection link of this type is actually a stamping, which is very easy to manufacture, and the only additional step is to twist the push on blades on the cross strip across the plane of the strip so that their flat planes will extend transversely with respect to the row along which they are arrayed and hence also with respect to the current bar. The current bar can then be provided with a simple longitudinal hole so that the design will also allow the desirable and in this case necessary relatively large conducting blade cross-section demanded for very considerable current intensities. A cross connection link of this type is quick and easy to apply in any desired number of poles and any desired modular terminal blade connection to this type of cross connection by inserting the cross connection link in a length appropriate to the desired number of poles into the longitudinal holes in the current bars of the particular modular terminal blocks once the push on blades have been separated from the cross connection link wherever there are modular terminal blocks in the array that are not intended to participate in the connection. This is simple to do by means of a predetermined break line where the blade is suspended from the cross connection link. Also practical are predetermined break lines in the cross connection link itself, transverse to it, and extending from the point at which the push on blades join the connection link so that a connection link with a desired number of poles can always be broken off.

Further preferred embodiments derive from the resilient slotting of the push on blades, which is especially practical when combined with insertion bevels and snap-in projections so that the push on blades are easy to insert into the current bars and are secured in them relatively reliably. Also practical is a protective cover for the cross connection link.

One preferred embodiment of the invention will now be described with reference to the attached drawing, wherein:

BRIEF DESCRIPTION OF THE DRAWING

The FIGURE is a perspective view of a cross connection link in accordance with the invention along with the parts of a modular terminal blocks that are adjacent to or operate in conjunction with it.

DETAILED DESCRIPTION OF THE PREFERRED EMBODIMENTS

The cross connection link in the FIGURE is a one-piece stamping with a long, metallic, conducting cross strip 1 that extends across a series of modular terminal blocks. A number of push on blades 2 project down from cross strip 1 in the form of a comb mortise. Blades 2 are twisted 90° with respect to cross strip 1 with their flat planes perpendicular to the longitudinal plane of the strip.

The cross connection link is intended to be employed in conjunction with a series of modular terminal blocks with current bars extending across the direction of the row parallel to the partitions of insulating material in the individual modular terminal blocks. The terminal block current bars 3, one of which is lightly indicated in the FIGURE, have blade holes 4 oriented along their length. Since push on blades 2 are twisted 90° with respect to cross strip 1, they can be inserted in blade holes 4 because their flat planes are transverse to the strip. This means that the push on blades 2 can have relatively large current conducting cross-sections.

Blades 2 are as far apart as the blade holes 4 in the current bars 3 in one array of modular terminal blocks. Blades 2 are long enough for them to be securely inserted into the current bars on the one hand and for the appropriate terminal block partition 5 of insulating material (lightly indicated in the FIGURE) to be accommodated in the empty space between two push on blades 2.

Any modular terminal blocks desired can be selected from an array of modular terminal blocks and a cross connection appropriate to the cross connection link being employed applied to them. For the modular terminal blocks of an arrangement that are not connected to this cross connection, the appropriate push on blades 2 are broken off of cross strip 1. This can be facilitated by a predetermined break line 6 that extends across blade 2 parallel to the length of cross strip 1.

There are also other predetermined break lines 7 that extend across cross strip 1 from the point at which the push on blades 2 are attached to it and facilitate breaking cross connectors with a desire number of poles off of a longer cross connection link.

The push on blades 2 on the cross connection link also have longitudinal slots 8 extending from the bottom over a considerable portion of their length and generating a spring tension in the area that they are inserted into. Initially this facilitates, in conjunction with insertion bevels 9 at the bottom of the push on blades, inserting them into the blade holes 4 in current bars 3. The spring tension also, however, contributes, especially in conjunction with small snap-in projections 10 on the narrow edge of the inserted area of push on blades 2, to securing the push on blades and hence the cross connection link as a whole in current bars 3 once they have been inserted. Snap-in projections 10 are located at a level on push on blades 2 at which they can easily snap in under current bars 3 subsequent to insertion.

The cross connection link also has contact protection in the form of a protective cover 11 of insulating material so that it can be handled without danger, which is especially important in this case because current can start to flow in some cases even at the very first contact between a blade 2 and a terminal-strip current bars 3.

It will be appreciated that the instant specification and claims are set forth by way of illustration and not limitation, and that various modifications and changes may be made without departing from the spirit and scope of the present invention.

What is claimed is:

1. In a cross connection link with a conductive cross strip and downward projecting conductive push on blades terminating in free ends below the cross strip for modular terminal blocks with perforated current bars that accept the push on blades, the improvement wherein a number of push on blades are planar longitudinal fingers extending from regions of attachment and arrayed in a comb mortise along the cross strip and wherein the blades are twisted by rotation substantially about their axes with torsional deformation at the regions of attachment and with their flat planes at the free ends thereof extending transversely with respect to the row along which they are arrayed, the blades being inserted through the current bar perforations to electrically interconnect the current bars.

2. The cross connection link as in claim 1, wherein the push on blades have longitudinal slots extending from the bottom thereof and over a portion of their length to provide resilence during insertion.

3. The cross connection link as in claim 2, wherein the push on blades have insertion bevels at the bottom thereof.

4. The cross connection link as in claim 3, wherein the push on blades have a snap-in projection on at least one narrow edge at the bottom thereof to retain the blades in place after insertion.

5. The cross connection link as in claim 1, wherein the push on blades have a cross predetermined break line at the top thereof and parallel to the cross strip.

6. The cross connection link as in claim 1, wherein the cross strip has predetermined break lines that extend across cross strip from the point at which the push on blades are attached to it.

7. The cross connection link as in claim 1, wherein the cross strip is surrounded with a protective cover of insulating material.

8. The cross connection link as in claim 1, wherein the push on blades are twisted 90° with respect to the cross strip.

* * * * *